US005613392A

United States Patent [19]

Müller et al.

[11] Patent Number: 5,613,392

[45] Date of Patent: Mar. 25, 1997

[54] HORIZONTAL/VERTICAL ROLL STAND

[75] Inventors: Hubert Müller, Grevenbroich; Konrad Hamraths, Kaarst, both of Germany

[73] Assignee: SMS Schloemann-Siemag Aktiengesellschaft, Dusseldorf, Germany

[21] Appl. No.: 334,785

[22] Filed: Nov. 4, 1994

[30] Foreign Application Priority Data

Nov. 6, 1993 [DE] Germany ..... 43 37 935.4

[51] Int. Cl.[6] ..... B21B 31/24

[52] U.S. Cl. ..... 72/238; 72/248

[58] Field of Search ..... 72/224, 225, 237, 72/238, 239, 248

[56] References Cited

U.S. PATENT DOCUMENTS

| | | | |
|---|---|---|---|
| 4,706,484 | 11/1987 | Dittmar et al. | 72/225 |
| 4,763,505 | 8/1988 | Klute et al. | 72/238 |
| 4,823,584 | 4/1989 | Haynes | 72/225 |
| 5,457,979 | 10/1995 | Castellani | 72/225 |

FOREIGN PATENT DOCUMENTS 0281782 9/1988 European Pat. Off. .

*Primary Examiner*—Lowell A. Larson
*Assistant Examiner*—T. Schoeffler
*Attorney, Agent, or Firm*—Friedrich Kueffner

[57] ABSTRACT

A horizontal/vertical roll stand with a pair of work rolls which can be exchangeably mounted with chocks and adjusting spindles in the stand includes a housing which is formed by four posts which extend from the corners of a common base plate, wherein the posts have an essentially rectangular cross-section. A cube-shaped receiving space which is open toward the top and at the sides for a cassette-type roll mounting unit is defined by the base plate and the four posts. During the exchange of the rolls, the roll mounting unit can be pulled out as a structural unit from the receiving space of the stand. Pairs of the posts form guides therebetween. A total of four support plates with a center support member each for four adjusting spindles are releasably fastened to the guides. The adjusting spindles have adjusting nuts on right/left thread portions, wherein pairs of adjusting nuts engage with cylindrically shaped projections into chocks of the rolls and adjust the rolls.

6 Claims, 6 Drawing Sheets

HORIZONTAL/VERTICAL ROLL STAND

BACKGROUND OF THE INVENTION

1. Field of the Invention

The present invention relates to a horizontal/vertical roll stand with a pair of work rolls which can be exchangeably mounted with chocks and adjusting spindles in the stand.

2. Description of the Related Art

U.S. Pat. No. 4,763,505 discloses a roll stand with a roll changing unit which makes possible the mounting of rolls in different arrangements and dimensions and of different numbers of rolls. Pairs of horizontal support beams are inserted between vertical stand posts, wherein the support beams have guide grooves for horizontally insertable chocks which are engaged in a positively locking manner by the chocks with lateral slide elements which receive the roll bearings. For fitting the stand, for example, as a six-high stand, insertable intermediate support members are provided. This known roll stand is of relatively cumbersome and complicated construction.

EP-A-0 281 782 discloses a method of converting a roll stand from one type of roll stand to another type of roll stand with a different number of effective rolls, wherein, depending on the intended type of stand, the rolls are inserted as roll change units. In accordance with this method, the rolls together with their chocks are placed in guide members attached to the roll housing, wherein the rolls are inserted in a vertical arrangement between the back-up rolls in a positively locking manner and with the possibility of displacement along the roll axis, and wherein, for using the stand as a two-high stand, spacer members are placed between the chocks of the work rolls and the chocks of the back-up rolls.

SUMMARY OF THE INVENTION

Starting from the roll stands described above, it is the primary object of the present invention to provide a horizontal/vertical roll stand with adjusting spindles which is of simple construction and improves the output in practical use, wherein the difficulties of a simple solution are to be overcome without reducing the quality, and favorable conditions are to be realized for an extremely quick roll change.

In accordance with the present invention, a horizontal/vertical roll stand of the above-described type includes a housing which is formed by four posts which extend from the corners of a common base plate, wherein the posts have an essentially rectangular cross-section. A cube-shaped receiving space which is open toward the top and at the sides for a cassette-type roll mounting unit is defined by the base plate and the four posts. During the exchange of the rolls, the roll mounting unit can be pulled out as a structural unit from the receiving space of the stand. Pairs of the posts form guide means therebetween. A total of four support plates with a center support member each for four adjusting spindles are releasably fastened to the guide means. The adjusting spindles have adjusting nuts on right/left thread portions, wherein pairs of adjusting nuts engage with cylindrically shaped projections into chocks of the rolls and adjust the rolls.

The configuration according to the present invention advantageously provides optimum prerequisites for a quick roll change and for a remote-control adjustment of the roll gap by using very uncomplicated, inexpensive and, thus, economical means. Since, after separating the fittings and the drive shafts and the clamping claws which connect the support plates to the posts of the horizontal/vertical roll stand, the cassette-type roll mounting unit can be easily pulled out of the receiving space, the times required for the roll change are reduced. This produces the advantage that a roll change can be carried out during a bridging period available in the rolling line.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
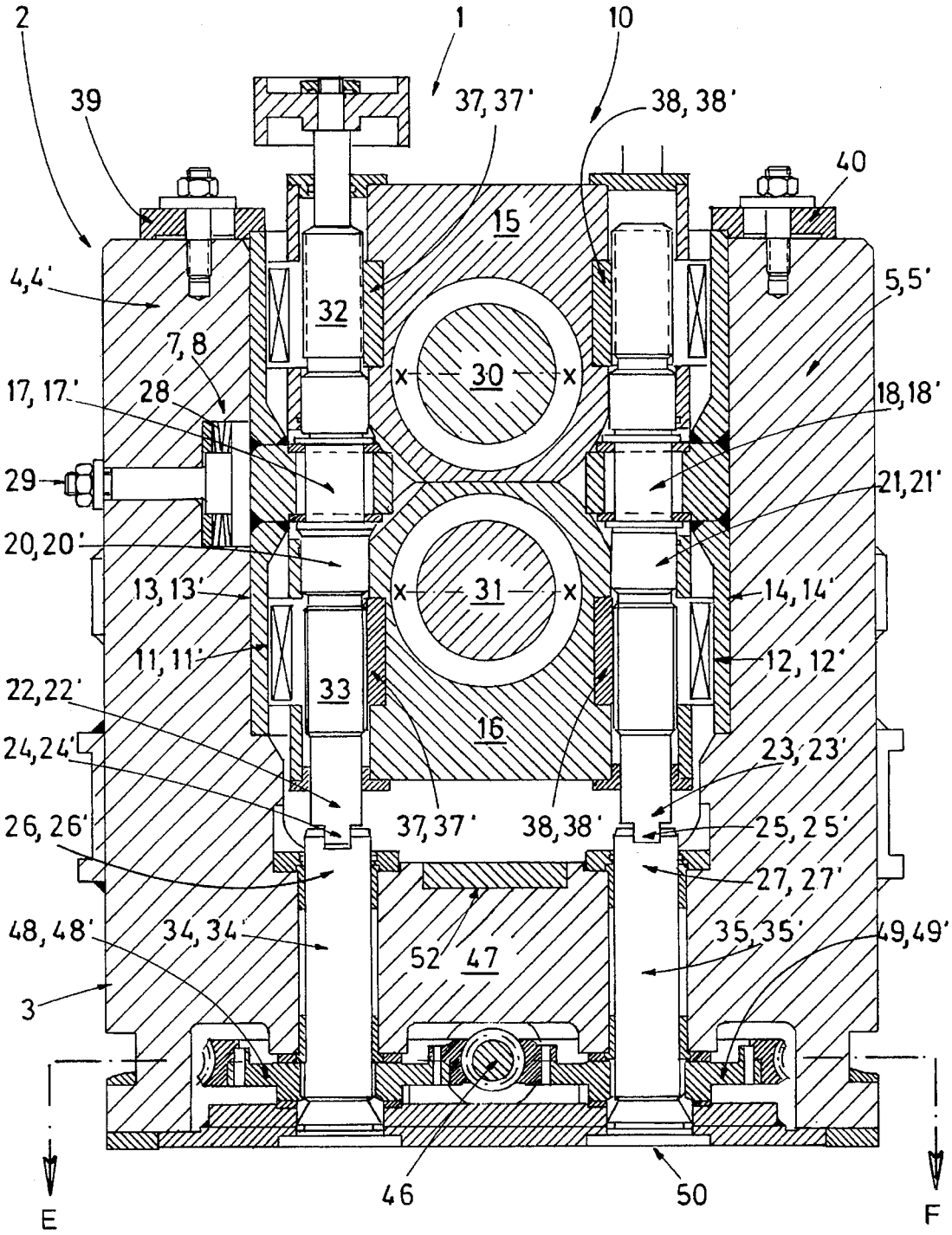
FIG. 1 is a sectional view of the horizontal/vertical roll stand according to the present invention, taken along sectional plane C–D of FIG. 5.

FIG. 1 of the drawing shows a horizontal/vertical roll stand 1 in a sectional plane extending perpendicularly to the roll axes. In particular, FIG. 1 shows the arrangement of work rolls 30, 31 in the manner in which the work rolls 30, 31 are supported in the chocks 15, 16. The horizontal/vertical roll stand 1 includes a housing 2 which is formed by four posts 4, 4'; 5, 5' which have an essentially rectangular cross-section. The posts extend from the corners of a common base plate 3.

Figure 4:
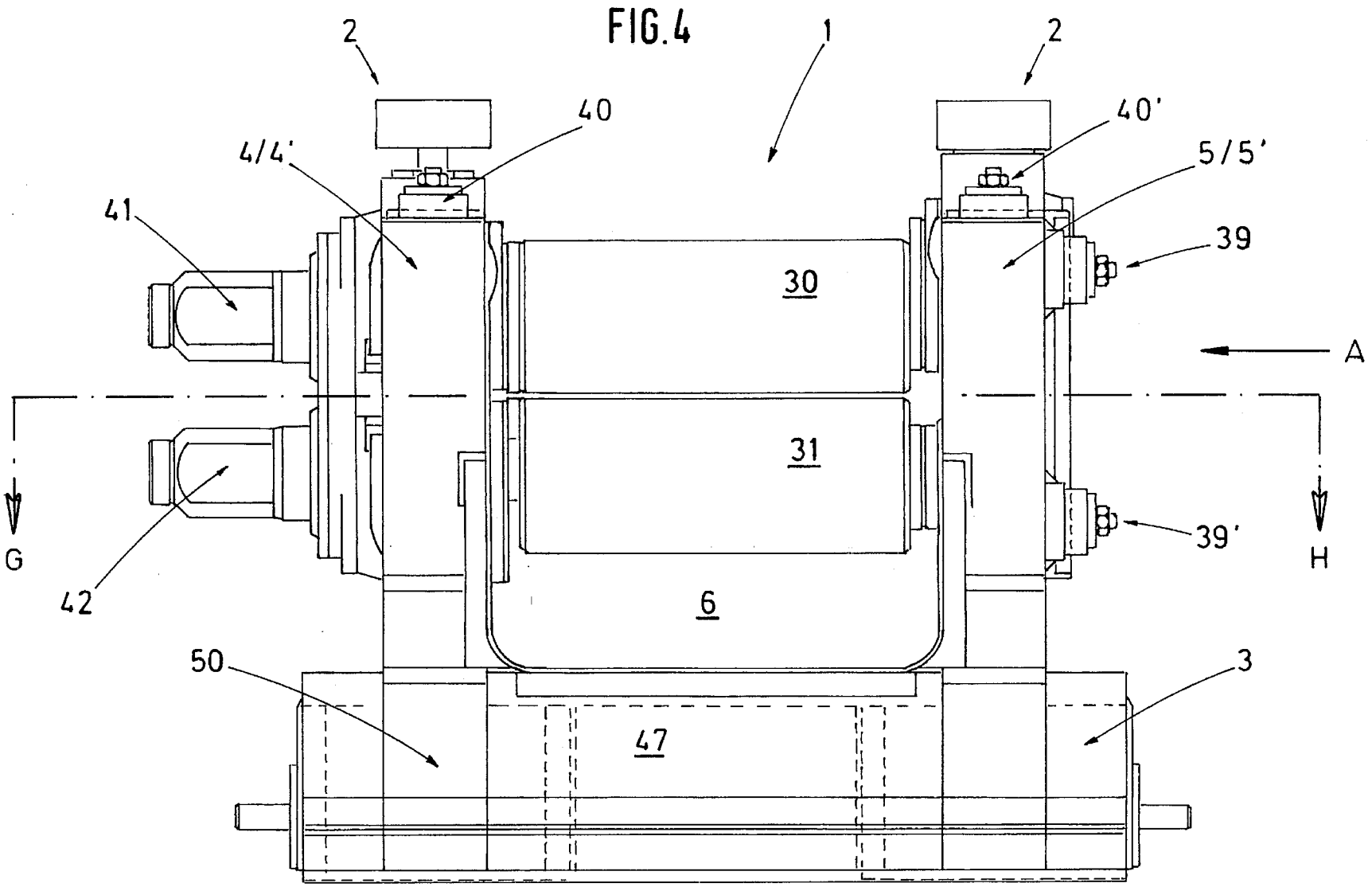
FIG. 4 is side view of the roll stand seen in a direction perpendicular to the roll gap.

As shown in FIG. 4, the four posts 4, 4'; 5, 5' form together with the base plate 3 a cube-shaped receiving space 6 which is open toward the top and at the sides. The receiving space 6 serves to receive a cassette-type roll mounting unit 10. During the exchange of the rolls 30, 31, the roll mounting unit 10 can be pulled upwardly as a self-enclosed structural unit from the stand 1. This is particularly facilitated by the fact that the synchronized gear unit 50 for adjusting the adjusting spindles 20, 20'; 21, 21' is integrated in the base plate 3, wherein the adjusting spindles can be uncoupled from the drive shafts 34, 34'; 35, 35' of the synchronized worm drive 50 without requiring assembly operations.

Figure 6:
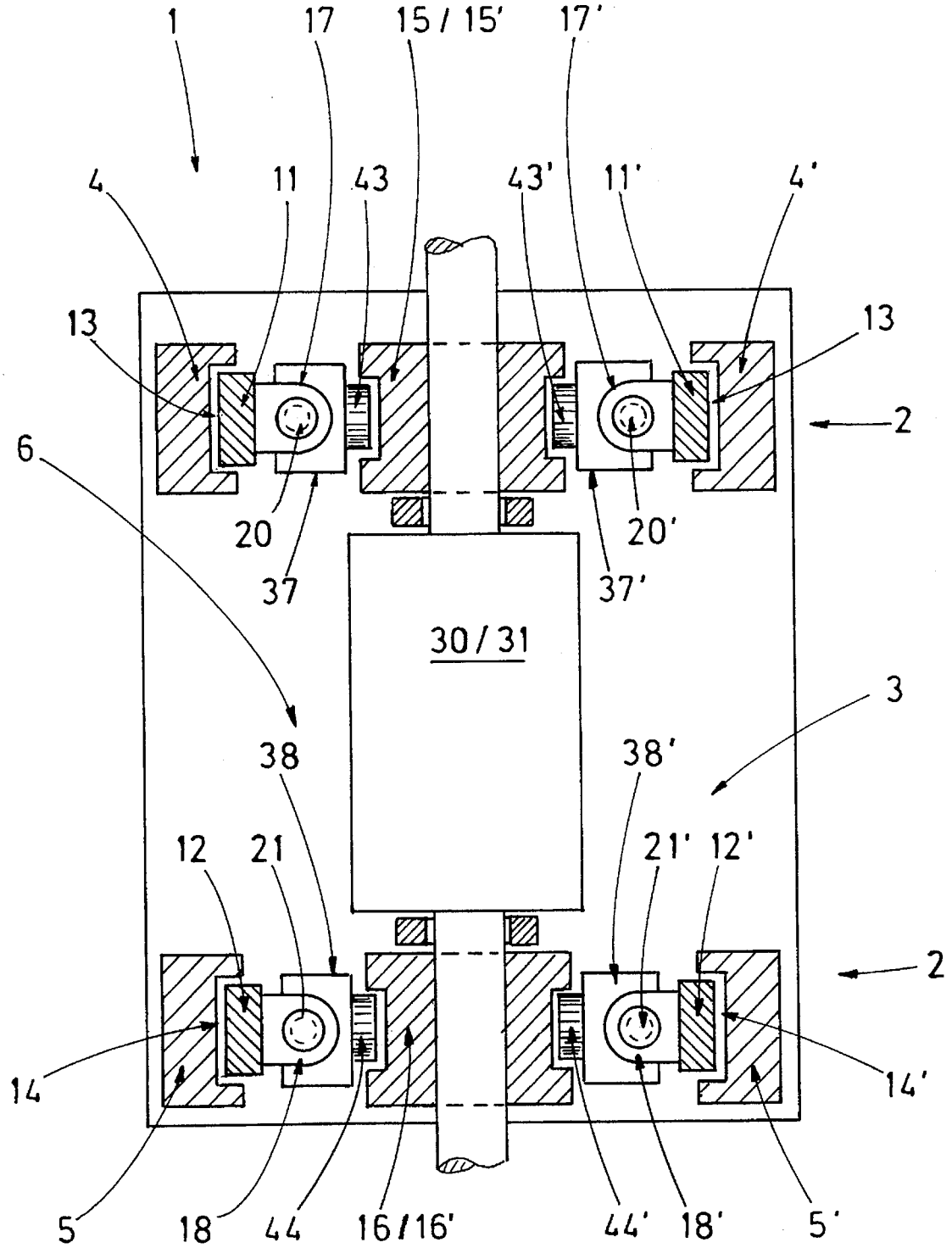
FIG. 6 is a sectional view of the roll stand taken along sectional plane G–H of FIG. 4.

Guide members 13, 13' and 14, 14' are formed between pairs of the four posts 4, 4' and 5, 5'. A total of four support plates 11, 11'; 12, 12' with a center support member each 17, 17' and 18, 18' for the four adjusting spindles 20, 20'; 21, 21' are releasably fastened to the guide members. The adjusting spindles have right/left threaded portions 32, 33. The right/left threaded portions support adjusting nuts 37, 37'; 38, 38' with cylindrically shaped projections 43, 43'; 44, 44' which, as shown in FIG. 6, engage in pairs in the chocks 15, 16 of the rolls 30, 31 and adjust the chocks 15, 16.

As illustrated in FIG. 1, the support plates 11, 11'; 12, 12' are quickly releasably clamped to the posts 4, 5 by means of clamping claws 39, 40. The arrangement is such that the adjusting spindles 20, 20'; 21, 21' project downwardly out of the chocks 16 and are at their lower ends 22, 23 shaped as coupling claws 24, 24'; 25, 25' which decouplably engage in the coupling heads 26, 26'; 27, 27' of the four-way synchronized gear unit 50 which is mounted in the base plate 3 of the stand 1.

As further illustrated in FIG. 1, the engagement of the adjusting nuts 37, 37'; 38, 38' in the chocks 15, 16 is located approximately in the area of the roll axes x—x.

Two pressure pieces are arranged on the posts 4, 4'; 5, 5' on the operating side or drive side. By means of plate springs 28, the pressure pieces 7, 8 exert an elastic pressure against the rear sides of the support plates 11, 11'; 12, 12' and can be adjusted or released by means of a threaded rod and a nut 29. The pressure pieces 7, 8 have the purpose of aligning the roll mounting unit during rolling without play in the housing 2.

In accordance with an advantageous feature, the worm gears 48, 48'; 49, 49' of the synchronized gear unit 50 provided for rotating the adjusting spindles 20, 20'; 21, 21' are adjustably constructed and arranged in the gear housing 47 formed by the base plate 3. For this purpose, the gear housing 47 is provided with an inspection opening and a cover 52 for closing the inspection opening.

Figure 3:
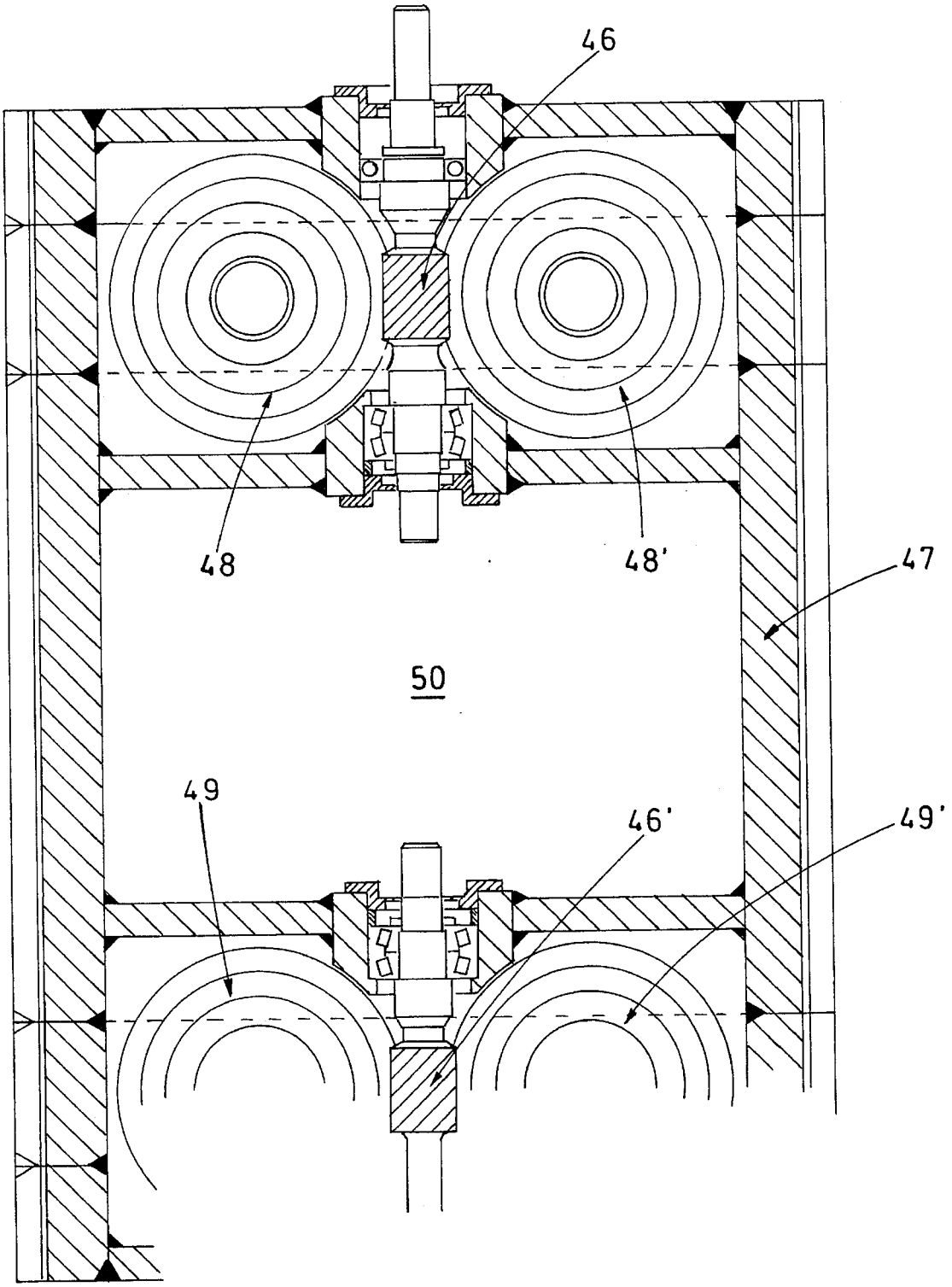
FIG. 3 is a sectional view of a synchronized gear unit taken along sectional plane E–F in FIG. 1.

FIG. 3 of the drawing shows that the gear unit 50 is a four-way worm gear unit and includes the worm gears 48, 48'; 49, 49' and drive pinions 46, 46'. Stub shafts of the drive pinions 46, 46' project out of both sides of the gear housing 47, wherein the stub shafts can be connected to motor drive means, possibly remote-controlled drive means, not shown.

Figure 2:
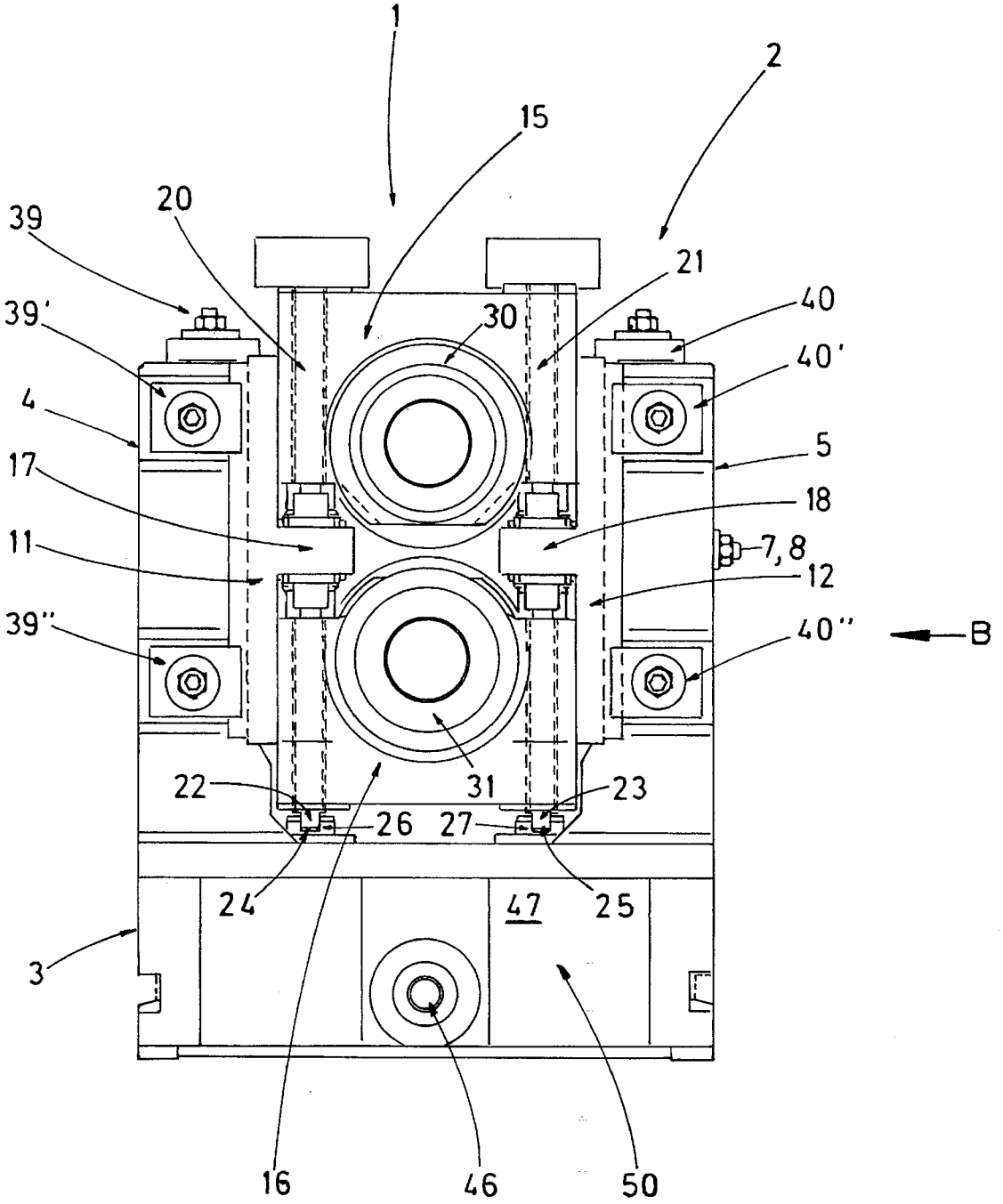
FIG. 2 is a view of the stand from the direction A in FIG. 4, wherein the front chocks are removed.

FIG. 2 of the drawing is a side view of the stand 1 with the housing 2 seen in the direction of arrow A in FIG. 4. For clarity's sake, the chocks arranged in the direction of view are removed, so that the front sides of the rolls 30, 31 and the rear chocks 15, 16 can be seen. This view shows the clamping claws 39, 39', 39"; 40, 40', 40" by means of which the guide plates 11, 12 are clamped to the posts 4, 5 at the corners of the housing 2 in a manner which can be easily clamped as well as easily separated.

FIG. 2 additionally shows the manner in which the spindles 20, 21 are supported in the center support members 17, 18 of the guide plates 11, 12 provided for this purpose. In addition, FIG. 2 shows the engagement, which can be decoupled without problems, of the lower spindle ends 22, 23 constructed as coupling claws 24, 25 in the compatible coupling heads 26, 27 of the drive shafts of the four-way synchronized gear unit 50.

FIG. 4 of the drawing is a view of the horizontal/vertical roll stand seen in the direction of arrow B in FIG. 2. Equivalent elements are denoted by the same reference numerals. The left-hand side of FIG. 4 shows the drive shafts 41, 42 of the work rolls 30, 31. FIG. 4 illustrates the surprisingly uncomplicated construction of the housing 2. The housing 2 is composed essentially of the massive base plate 3 which receives the housing 47 of the four-way synchronized gear unit 50, and of the four posts 4, 4'; 5, 5' which are arranged in the corners, have essentially a rectangular cross-section and are preferably case in one piece with the structural base unit 3. Moreover, FIG. 4 shows the clamping elements 39, 39', 39" for fastening the support plates, wherein, however, the support plates are not visible in this view since they are located behind the posts 4, 4'; 5, 5'.

Figure 5:
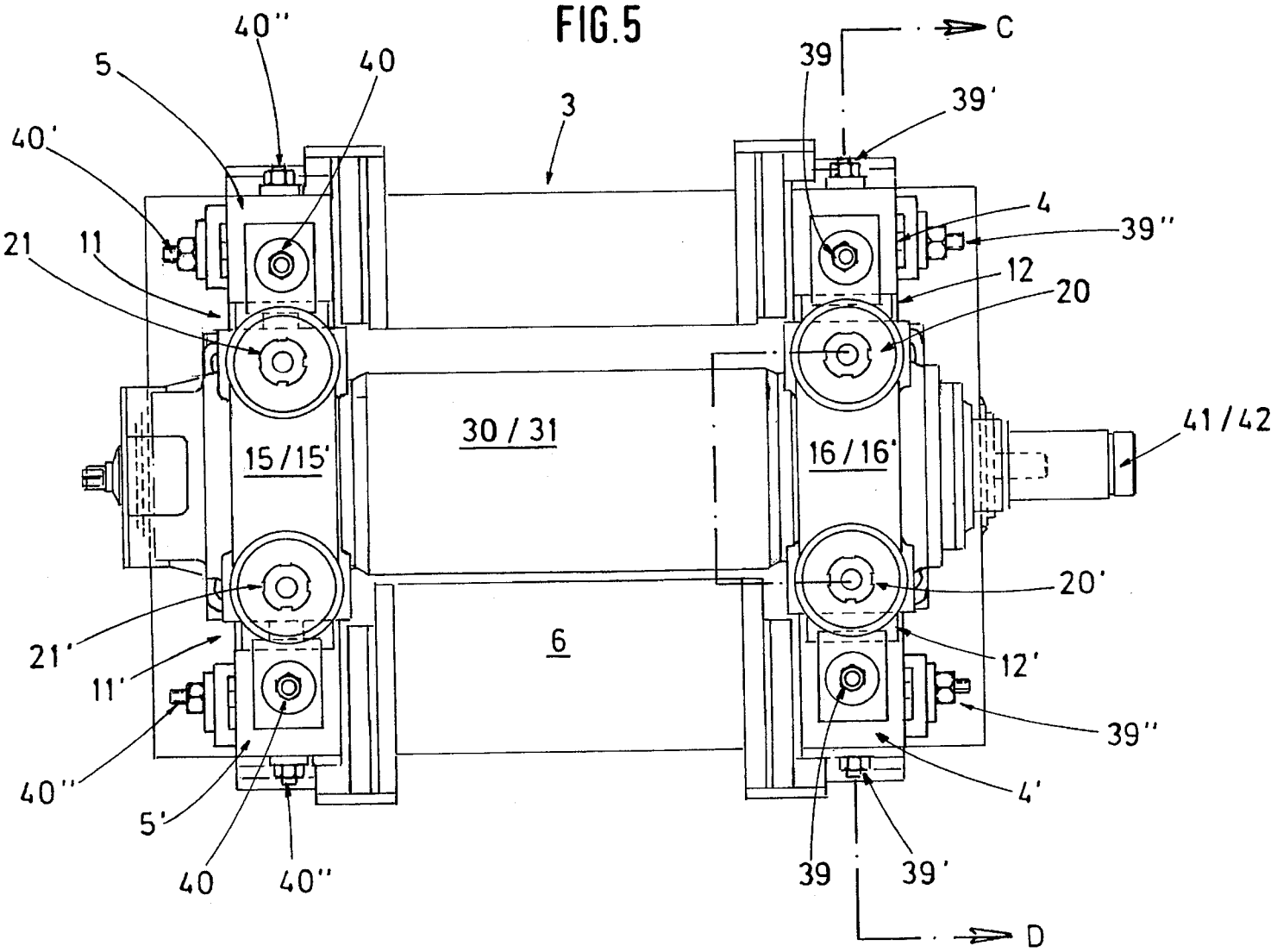
FIG. 5 is a top view of the horizontal/vertical roll stand.

The top view of FIG. 5 shows the arrangement of the four posts 4, 4'; 5, 5' and also the arrangement of the adjusting spindles 20, 20'; 21, 21' relative to the chocks 15, 15'; 16, 16'. The illustration of FIG. 4 further shows the arrangement of the clamping claws 39, 39', 39"; 40, 40', 40" for clamping the support plates 11, 11'; 12, 12'.

Finally, FIG. 6 of the drawing is a sectional view along plane G–H of FIG. 4 and shows from the top the arrangement of the principal elements of the horizontal/vertical roll stand 1 or of the housing 2. FIG. 6 shows in a simplified and, thus, particularly clear manner the four posts 4, 4'; 5, 5' in the corners with the guide means 13, 13'; 14, 14' for the four support plates 11, 11'; 12, 12' and the center support members 17, 17'; 18, 18' for the four adjusting spindles 20, 20'; 21, 21' and the adjusting nuts 37, 37'; 38, 38' which are guided from the inside and are in engagement with projections 43, 43'; 44, 44' in the chocks 15, 15'; 16, 16'. In order to be able to compensate for transverse inclinations, the projections 43, 43'; 44, 44' are cylindrically shaped and engage in compatible recesses of the chocks 15, 15'; 16, 16'.

The horizontal/vertical stand according to the present invention is of uncomplicated construction and, therefore, makes possible a surprisingly quick roll change.

The invention is not limited by the embodiments described above which are presented as examples only but can be modified in various ways within the scope of protection defined by the appended patent claims.

We claim:

1. A horizontal/vertical roll stand, comprising a housing, the housing comprising a base plate having four corners, four posts connected to and extending upwardly from the four corners of the base plate, the posts having an essentially rectangular cross-section, a cube-shaped upwardly and laterally open receiving space being defined between the posts and the base plate, a cassette-type roll mounting unit including a pair of work rolls being received in the receiving space, such that for changing the rolls the roll mounting unit can be pulled upwardly as a structural unit out of the receiving space, wherein pairs of the posts form guide means therebetween, the roll stand further comprising four adjusting spindles and chocks, four support plates comprising a center support member each for the four adjusting spindles being releasably fastened to the guide means, the adjusting spindles comprising right/left thread portions, adjusting nuts being mounted on the right/left thread portions, each adjusting nut having a cylindrically shaped projection, wherein pairs of the adjusting nuts engage with cylindrically shaped projections into the chocks for adjusting the rolls, further comprising clamping claws for mounting the support plate on the posts, wherein the adjusting spindles have lower ends projecting downwardly out of the chocks, the lower ends forming coupling claws, a four-way synchronized gear unit being integrated into the base plate of the housing, the four-way synchronized gear unit having coupling heads, wherein the coupling claws engage in a releasable manner in the coupling heads.

2. The roll stand according to claim 1, wherein the four-way synchronized gear unit is a four-way worm gear unit.

3. The roll stand according to claim 1, wherein the rolls have axes, the adjusting nuts engaging the chocks approximately at the roll axes, the adjusting nuts being rotatably mounted on the chocks such that misalignments are prevented.

4. The roll stand according to claim 1, the roll stand having a drive side, two pressure pieces being mounted on the posts for exerting an elastic pressure against rear sides of the support plates, and a threaded rod and a nut for adjusting the pressure pieces.

5. The roll stand according to claim 2, wherein the gear unit comprises worm gears for effecting a rotation of the adjusting spindles, the worm gears being adjustably mounted in the base plate.

6. The roll stand according to claim 1, wherein the gear unit comprises a gear housing, the gear housing defining an inspection opening, further comprising a cover for closing the inspection opening.

* * * * *